United States Patent [19]

Parks

[11] Patent Number: 4,747,176

[45] Date of Patent: May 31, 1988

[54] PADHOLDER FOR FLOOR POLISHER

[75] Inventor: Eugene R. Parks, Tulsa, Okla.

[73] Assignee: Daisy Janitorial Service, Inc., Tulsa, Okla.

[21] Appl. No.: 56,959

[22] Filed: Jun. 1, 1987

[51] Int. Cl.[4] ..... A47L 11/164

[52] U.S. Cl. ..... 15/230.16; 15/98; 51/177

[58] Field of Search ..... 15/230 R, 230.14, 230.16, 15/230.17, 230.18, 98, 385; 51/358, 376, 177

[56] References Cited

U.S. PATENT DOCUMENTS 1,665,292 4/1928 Anderson et al. ..... 15/230.18
1,673,160 6/1928 Ross ..... 15/230.18
4,701,970 10/1987 Wilson ..... 15/98
4,709,439 12/1987 Warren et al. ..... 15/230.16

*Primary Examiner*—Edward L. Roberts
*Attorney, Agent, or Firm*—Dorman & Kachigian, Inc.

[57] ABSTRACT

A novel padholder for a floor polishing or burnishing apparatus having a rotating drive shaft and a circular polishing or burnishing pad which includes planar, resilient arms radiating from a center point, spring means for each arm extending from the center point along each arm in order to urge the arm toward the floor, means to detachably connect the circular pad to the padholder, and means to connecting the rotating drive shaft to the padholder at the center point.

3 Claims, 3 Drawing Sheets

PADHOLDER FOR FLOOR POLISHER

BACKGROUND OF THE INVENTION

1. Field of the Invention

The present invention relates to a novel padholder for a floor polishing or burnishing machine that will accommodate irregularities in a floor.

2. Background of the Invention

Commercial floor polishing or burnishing machines are well known. Typically, a motor drives a shaft that is rotated at high speed to which is attached a padholder. In turn, the padholder secures a polishing pad which rotates to polish a floor. The machines themselves may vary—from electric motor to internal combustion engines. Invariably, however, the padholder is a thin, rigid, metal disc.

Most flat-looking floors actually contain sloping peaks and valleys throughout. The rigid disc padholder, even if flexible to a limited degree, is not able to accommodate sloping peaks and valleys. The result is a floor that is not adequately polished.

In the present invention a padholder is used having flexible arms. The resilient arms operate independently to seek low or high places in the floor.

A patentability search was conducted on the present invention and the following U.S. patents were uncovered in the search:

| Patentee | U.S. Pat. No. | Issue Date |
|---|---|---|
| Brown et al | 3,550,179 | December 29, 1970 |
| Schar | 4,293,973 | October 13, 1981 |
| Young | 3,416,177 | December 17, 1968 |
| Danzig | 3,644,960 | February 29, 1972 |
| Young et al | 3,703,739 | November 28, 1972 |
| Sullivan | 3,464,075 | September 2, 1969 |
| Richardson | 3,072,942 | January 15, 1963 |
| Davis | 3,583,017 | June 8, 1971 |
| Bilde | 3,354,488 | November 28, 1967 |

Sullivan (U.S. Pat. No. 3,464,075) discloses a circular metal disc padholder having a vertically resilient feature. It is constrained, however, to a disc and does not have the flexibility of the independently operating arms of the present invention.

Brown (U.S. Pat. No. 3,550,179) discloses pressure pads on the padholder including coil springs which urge the pressure pads toward the floor. Coil springs would be bulky and unwieldy if utilized in the present invention. The padholder and accompanying pad would not be able to get under overhanging counters and the like.

Young (U.S. Pat. No. 3,416,177) discloses a rectangular plate rather than a circular disc that oscillates rather than rotates.

The remaining references are of no more pertinence than those previously mentioned.

It is a principal object and purpose of the invention to provide a novel padholder for a floor polishing or burnishing machine which utilizes flexible, resilient arms.

It is a further object and purpose of the present invention to provide a novel padholder for a floor polishing or burnishing machine having flat springs to urge the resilient arms towards the floor.

It is a further object and purpose of the present invention to provide a novel padholder which promotes extended life for the polishing pads.

SUMMARY OF THE INVENTION

The present invention is to be used with a floor polishing or burnishing machine. The padholder must be capable of holding a polishing or burnishing pad firmly when in use while allowing for quick and simple replacement of the pad. The pad is secured on one side to the padholder. The padholder is, in turn, attached to a rotating drive shaft. A bell housing shields the padholder.

A plurality of planar arms extend from the shaft which acts as a center axis. The shaft is rotated clockwise by an engine. The arms are substantially flat and are flexible and resilient. The drive shaft, extending from the engine, terminates in a shaft plate perpendicular to the shaft. The shaft plate has threaded openings which mate with openings which mate with openings in the arms to accommodate bolts.

Extending in a direction perpendicular to the shaft are flat metal springs. A spring is provided for each arm and extends the length of the arm. The springs are located between the plate and the arms. The springs also include openings which mate with the openings in the plate and the openings in the arms to accommodate the bolts.

Each spring terminates in an end which provides a force to exert pressure on the spring's arm towards the floor.

The pad is removeably secured to the padholder through a plurality of Velcro buttons. Additionally, a center bolt is received through a center opening in the pad. The center bolt is accommodated through an opening in the arms and openings in the springs and is threadably received in an opening in the plate and shaft.

As the polishing machine is moved across the floor, the spring-back arms quickly respond to the floor configuration by flexing upward to peaks and downward to valleys.

Each spring is slightly narrower than the width of its respective arm. One edge on each arm is bent away from the floor to prevent any floor obstruction from damaging the padholder or the pad.

DETAILED DESCRIPTION OF THE PREFERRED EMBODIMENTS

Figure 1:
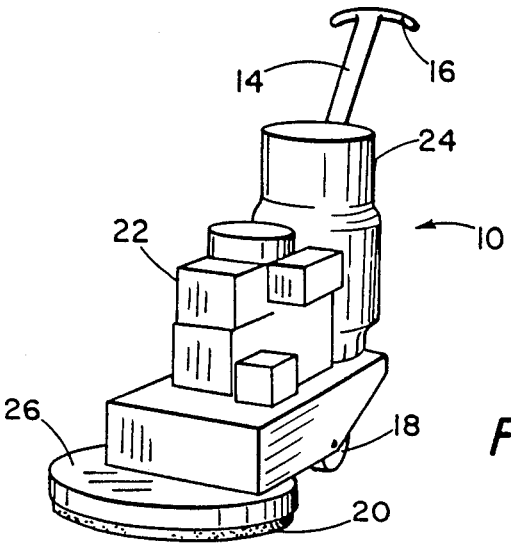
FIG. 1 is a perspective view of a floor polishing or burnishing machine with which the present invention is used.

Referring to the drawings in detail, FIG. 1 shows a perspective view of a typical floor polishing or burnishing machine 10 with which the present invention is used. The floor polishing or burnishing machine itself is not novel and may take a variety of forms. In the embodiment of the floor polishing machine 10 shown in FIG. 1, a sloping handle 14 extends from the machine and a handlebar 16 is provided with controls for use by an operator (not shown). A rear wheel 18, or wheels, and a circular polishing or burnishing pad 20 rests on the floor.

A pad 20 is secured on one side to a padholder (not shown in FIG. 1). The pads, which come in several standard diameters, have a certain amount of vertical flexibility. Pads will wear over a period of time and will be replaced. The padholder must be capable of holding the pad firmly when in use while allowing for quick and simple replacement.

The padholder is attached to a rotating drive shaft which turns the padholder clockwise. Various motors are employed to rotate the drive shaft. An internal combustion engine 22 is shown in FIG. 1 along with a propane tank 24 for fuel. The padholder will be rotated from 1000 to 3000 revolutions per minute. A bell housing 26 shields the padholder (not shown in FIG. 1). The foregoing is by way of background and is not a part of the invention. In summary, a shaft driven by a motor rotates a flat padholder clockwise to which is attached a polishing or burnishing pad.

Figure 2:
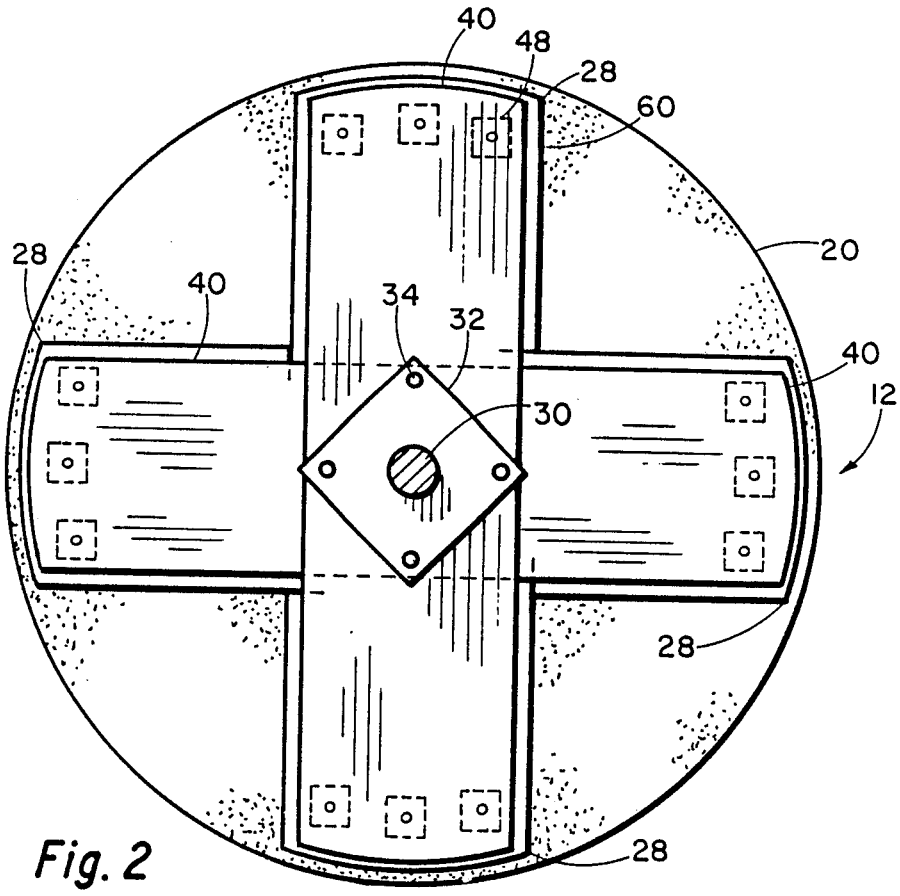
FIG. 2 is a top view of a novel padholder constructed in accordance with the present invention.

A top view of the padholder 12 of the present invention is shown in FIG. 2 apart from the polishing or burnishing machine 10. A plurality of planar arms 28 extend from the shaft 30 which acts as a center axis. As described, the shaft is rotated by the engine 22. The arms 28 are substantially flat and are flexible and resilient. It has been found that one-quarter inch thick polyethylene is particularly suited for this purpose. In the present embodiment, four arms 28 are utilized which form a "X" pattern. It should be understood, however, that a greater or lesser number of arms could be used. The drive shaft 30, extending from the engine 22, terminates in a shaft plate 32 perpendicular to the shaft. The plate 32 has a series of threaded openings 34 which mate with openings 36 in the arms 28 to accommodate bolts 38.

Extending in a direction perpendicular to the shaft 30 are flat metal springs 40. A spring is provided for each arm 28 and extends the length of the arm. The springs are secured to and juxtaposed between the plate 32 and the arms 28. The springs 40 also include openings 42 which mate with openings 34 in the plate and openings 36 in the arms 28 to accommodate the bolts 38. The arms 28 and springs 40 are thus secured to the plate 32.

Figure 3:
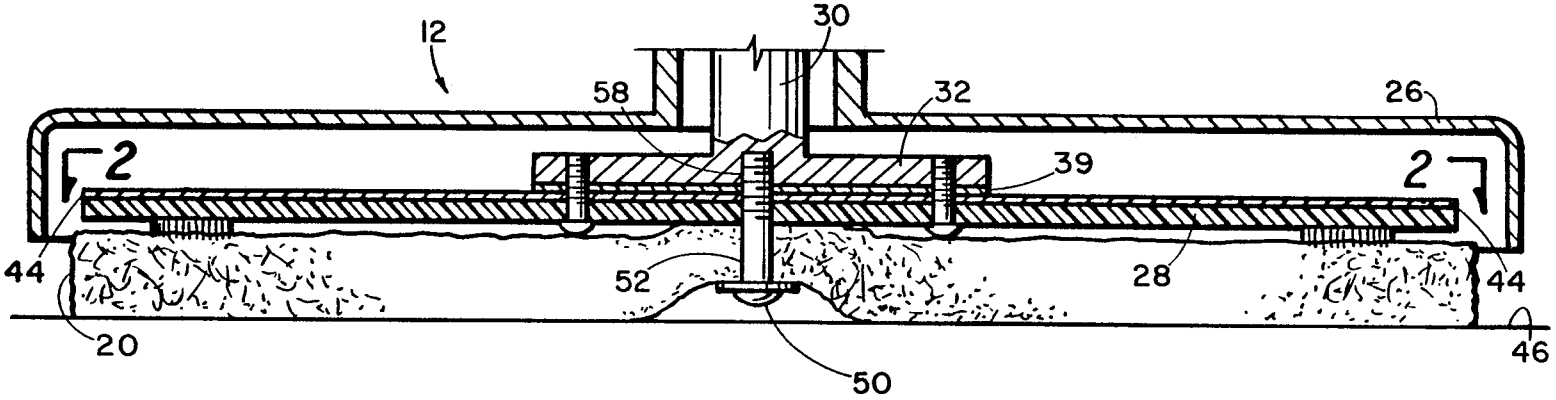
FIG. 3 is a sectional view of the present invention seen FIG. 2 resting on a flat floor.
Figure 4:
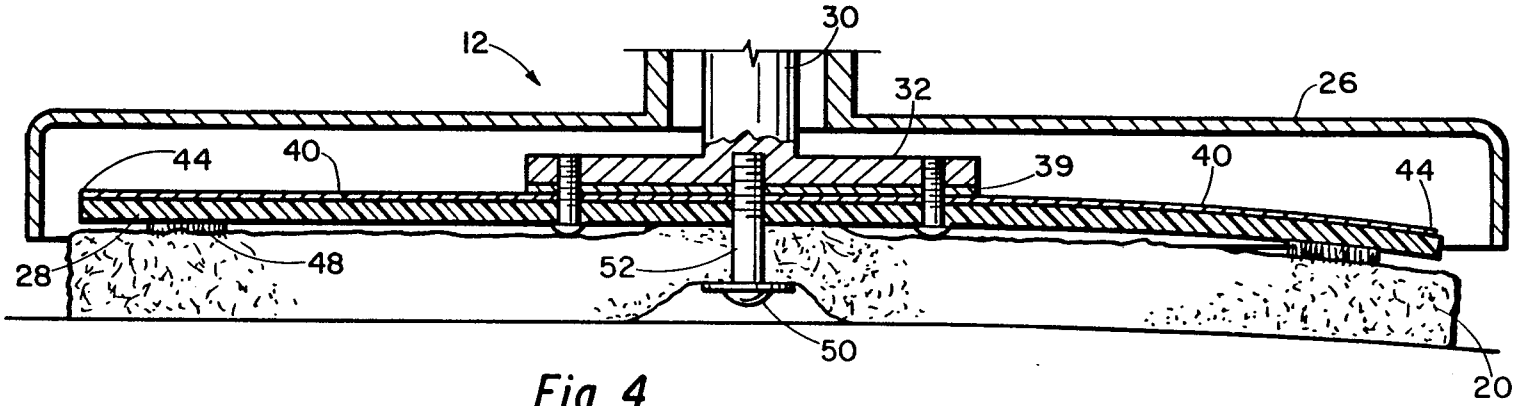
FIG. 4 is a sectional view of the present invention seen in FIG. 2 resting on a sloping floor.

FIGS. 3 and 4 show the relative positioning of the arms 28, the springs 40 and the plate 32. A washer plate 39 may be positioned between the springs 40 and the shaft plate 32. Each spring 40 terminates in an end 44 which provides a force to exert and maintain pressure on its arm 28 towards the floor 46. The combination of flexible, resilient arms and adjacent springs result in spring-backed arms.

The pad 20, seen in FIGS. 3 and 4, is removably secured to the padholder 12 in two ways. A plurality of Velcro buttons 48 are secured to the arms 28. The Velcro material will easily attach to the material of the pad 20. Additionally, a center bolt 50 is received through a center opening 52 in the pad 20. The center bolt also serves to center the pad on the padholder 12. The center bolt 50 is accommodated through an opening 54 in the arms 28 and opening 56 in the springs 40 and is threadably received in an opening 58 in the plate 32 and shaft 30.

When it is desired to replace a pad, the pad is pulled away from the Velcro buttons 48. The center bolt is then unscrewed and the pad removed. After a new pad is affixed to the Velcro buttons, the center bolt is replaced.

FIGS. 3 and 4 show different portions of a typical floor—one portion flat and another portion with irregularities. Upon close examination, even flat looking floors are, in reality, uneven. As the polishing machine 10 is moved across the floor 46, the spring-backed arms 28 quickly respond to the floor configuration by flexing upward to peaks and, as in FIG. 4, downward to valleys.

The responsiveness of the pad due to the present invention has been found to be superior to all other padholders.

A salient benefit of the present invention is that the design of the padholder serves to extend the life of the polishing pad 20. Initially, the flexible nature of the padholder arms reduces excessive pad wear. Moreover, since only part of the pad is being used because of the arms 28, after the pad wears, it can be removed and rotated 45° in relation to the padholder to utilize the unused portion of the pad.

Figure 5:
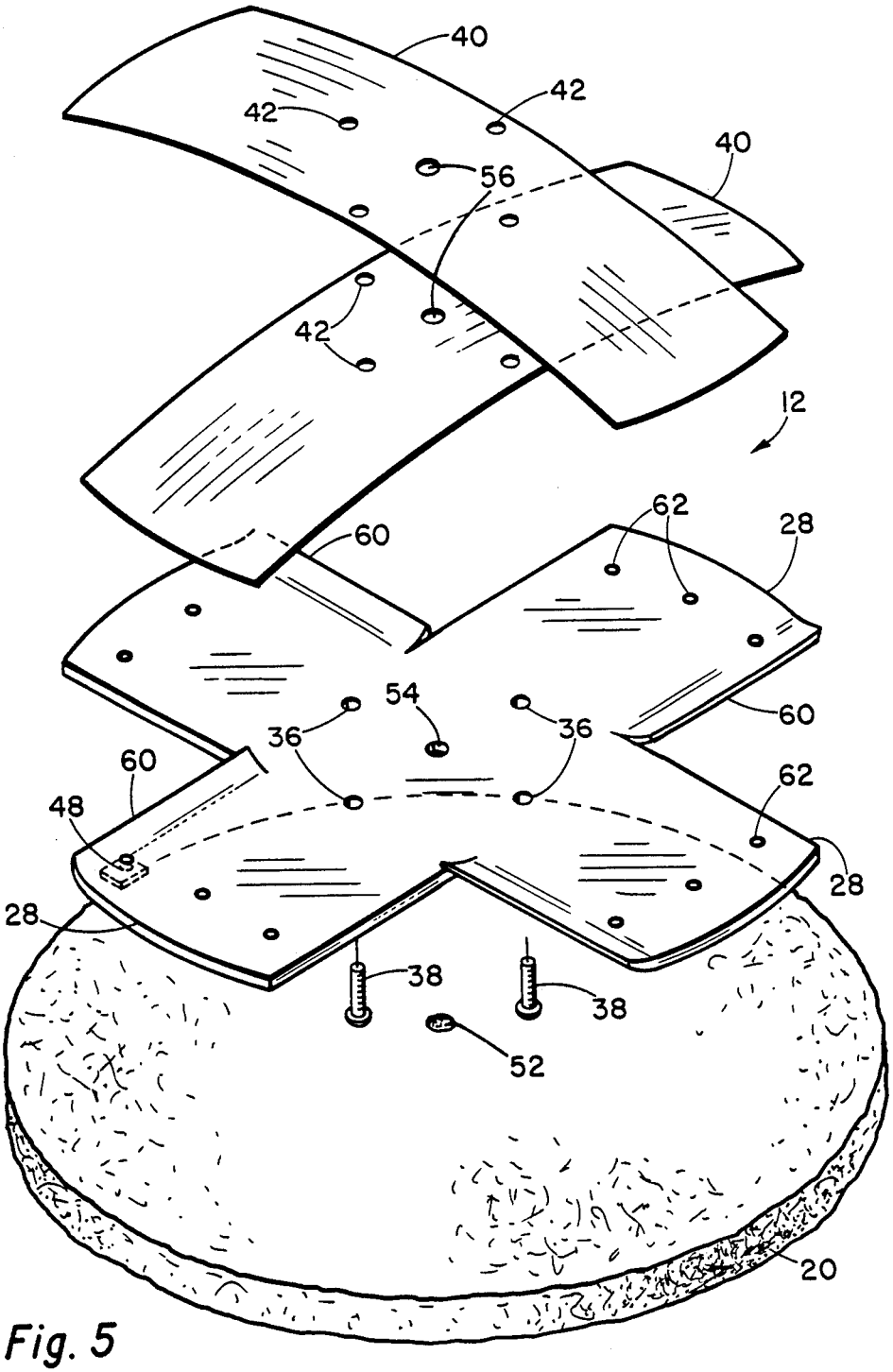
FIG. 5 is an exploded view of the present invention seen in FIG. 2.

FIG. 5 is an exploded view of the present invention along with a polishing pad 20. In the present embodiment, the springs 40 consist of two strips of equal length crossed in an "X" pattern. The arms 28 are fabricated from a single piece of polyethylene material.

As best seen in FIG. 2, each spring is slightly narrower than the width of its respective arm. With the padholder rotating clockwise, one edge of each arm will pass over the floor before the balance of the arm. Returning to a consideration of FIG. 5, one edge 60 on each arm 28 is bent away from the floor to prevent any floor obstruction from damaging the padholder or the pad.

The Velcro buttons 48 are snugly received in openings 62 in the arms 28.

Use of the present invention results in a floor that is polished or burnished throughout.

An additional benefit obtained through use of the present invention has been observed. It has been found that less engine power is required to drive the present padholder to achieve a satisfactory shine than to drive prior art padholders. It is believed this is due to the present invention operating in a more efficient manner.

Whereas the present invention has been described in particular relation to the drawings attached hereto, it should be understood that other and further modifications, apart from those shown or suggested herein, may be made within the spirit and scope of this invention.

What claimed is:

1. A novel padholder for a floor polishing or burnishing apparatus having a rotating drive shaft and a circular pad to polish or burnish a floor which comprises: a plurality of planar, resilient arms radiating from a center point; spring means for each arm, each spring means extending from said center point along said arm in order to urge said arm toward said floor; means to detachably connect said circular pad to said padholder; and means to connect said rotating drive shaft to said padholder at said center point.

2. A novel padholder as set forth in claim 1 wherein at least one edge of each arm is bent away from said floor in order to accommodate irregularities in said floor.

3. A novel padholder as set forth in claim 1 wherein said spring means comprises a flat spring.

* * * * *